US007592748B2

(12) United States Patent
Yeon

(10) Patent No.: US 7,592,748 B2
(45) Date of Patent: Sep. 22, 2009

(54) PLASMA DISPLAY PANEL WITH IMPROVED GROUNDING STRUCTURE

(75) Inventor: Kang Dae Yeon, Gumi-shi (KR)

(73) Assignee: LG Electronics Inc., Seoul (KR)

( * ) Notice: Subject to any disclaimer, the term of this patent is extended or adjusted under 35 U.S.C. 154(b) by 460 days.

(21) Appl. No.: 11/285,207

(22) Filed: Nov. 23, 2005

(65) Prior Publication Data

US 2006/0132691 A1 Jun. 22, 2006

(30) Foreign Application Priority Data

Dec. 7, 2004 (KR) ..... 10-2004-0102534

(51) Int. Cl.
*H01J 17/49* (2006.01)

(52) U.S. Cl. ..... 313/582; 313/479; 313/489; 313/111; 313/112

(58) Field of Classification Search ..... 313/112
See application file for complete search history.

(56) References Cited

U.S. PATENT DOCUMENTS 6,686,536 B2 * 2/2004 Tone et al. ..... 174/389
2004/0090182 A1 5/2004 Cha ..... 313/582
2004/0195948 A1 * 10/2004 Kim et al. ..... 313/112
2005/0017620 A1 * 1/2005 Kim et al. ..... 313/112

FOREIGN PATENT DOCUMENTS

JP 10-319855 12/1998
JP 11038893 A * 2/1999
JP 2003-066854 3/2003

OTHER PUBLICATIONS

Machine English translation of JP 10-319855 to Otsu.*
Machine English translation of JP 11038893 to Ito.*
Chinese Office Action dated Jan. 4, 2008.
Korean Office Action dated Aug. 30, 2006.

* cited by examiner

*Primary Examiner*—Sikha Roy
(74) *Attorney, Agent, or Firm*—Ked & Associates LLP

(57) ABSTRACT

Provided is a configuration for conveniently performing an ground with respect to a film-typed front filter, comprising: a panel; a film-typed front filter attached to a front surface of the panel; a back cover installed at the rear of the panel; a front cabinet equipped at the front of the panel; a frame electrically connected with the back cover; and a grounding member providing with the first point connected with the frame and the second point grounding the film-typed front filter upwardly as a different goods from the frame.

12 Claims, 7 Drawing Sheets

PLASMA DISPLAY PANEL WITH IMPROVED GROUNDING STRUCTURE

BACKGROUND OF THE INVENTION

1. Field of the Invention

The present invention relates to a plasma display panel, and more particularly, to a plasma display panel providing with a grounding structure appropriate for a film-typed front filter and a method thereof.

2. Description of the Related Art

A plasma display panel is a display device using a visible ray emitted from a fluorescent substance when the fluorescent substance is excited by an ultraviolet ray generated by a gas discharge. The plasma display panel PDP driven by the method is in a new trend in that PDP is thinner than a cathode ray tube CRT which is mainly used in a display device so far and light, and a high definition large screen can be realized. The plasma display panel consists of a plurality of discharging cells arranged in a matrix, each discharging cell configures one pixel, and the discharging cells gather to form an entire screen.

In general, a plasma display panel provides with a panel formed by that an upper substrate is cohered to a lower substrate, a front filter mounted on a front surface of the panel, a back cover formed to wrap a rear surface of a plasma display panel, a filter supporting portion connecting the front filter with the back cover and a front surface cabinet supporting the front filter. A radiative plate and a substrate are further formed on a rear surface of the panel, the substrate supplies a driving signal to a panel, and the panel displays a predetermined image in response to a driving signal.

In describing the operations of the above-described components in detail, the panel forms an image, the back cover protects the panel from an external impact and blocks an electromagnetic interference EMI emitted to the rear surface of a plasma display panel. The front surface cabinet is combined with the back cover to perform a role supporting the filter supporting portion and a supporting filter. The front filter blocks an EMI generated from the inside of the panel and prevents an external light from being reflected. To obtain this, a plurality of layers such as an antireflection layer, an optical characteristic layer, an EMI cutoff layer, and a near infrared ray NIR cutoff layer are provided on a front surface filter.

The filter supporting portion electrically connects the front filter to the back cover so that an EMI transmitted to a front surface filter is emitted to the outside through a back cover. In addition, the filter supporting portion performs a role preventing an EMI from being emitted through a side surface of a plasma display panel.

In describing a role of each layer of the front surface filter more particularly, the antireflection coating prevents a light impinged from the outside from being reflected to the outside again to improve a contrast of a plasma display panel. The optic characteristic layer lowers a brightness of red R and green G out of a light impinged from a panel and improves an optical characteristic of a plasma display panel by raising a brightness B. The EMI cutoff layer blocks an EMI and prevents the EMI impinged from the panel from being emitted to the outside. The NIR cutoff layer blocks an NIR impinged from a panel. The NIR cutoff layer prevents a NIR more than the reference from being emitted to the outside so that signals are normally transmitted from a remote controller to a panel.

In addition, it is general that a glass layer is further inserted as a glass consisting of the front surface filter so that a plurality of layers composing the front surface filter are firmly maintained. In addition, it is general that the EMI cutoff layer and the MIR cutoff layer are provided to the innermost of the front surface panel in order to improve a block capability of an EMI and NIR transmitted from the inside of a panel.

In the meantime, the front surface filter is electrically connected with a back cover through a filter supporting portion provided as a specific structure to emit a signal filtered by an EMI cutoff layer and a NIR cutoff layer of a plurality of layers of a front filter to the back cover. In addition, the filter supporting portion contacts with an inner surface of the front surface filter to contact with the EMI cutoff layer and the NIR cutoff layer out of a front surface filter.

However, a glass is inserted in the conventional front surface filter, an entire thickness of a front surface filter is thickened and a weight of a front surface filter is increased, therefore a manufacture cost is risen.

In addition, a configuration of a filter supporting portion becomes complicated and a manufacture process becomes difficult so that the filter supporting portion contacts with the innermost surface of the front surface filter.

SUMMARY OF THE INVENTION

In order to improve problems, it is an object of the present invention to provide with a plasma display panel of which a plasma display panel becomes thinner so that a film-typed front filter is adjusted in a plasma display panel.

In addition, it is another object of the present invention to provide with a grounding structure appropriate for a film-typed front panel, and EMI and NIR are smoothly emitted in the film-typed front filter.

Furthermore, it is another object of the present invention to provide with a plasma display panel to improve a convenience of the manufacture and reduce costs by simply configuring a grounding structure of a front filter.

In order to obtain the object of the present invention, a plasma display panel comprises: a panel; a film-typed front filter attached to a front surface of the panel; a back cover equipped at the rear of the panel; a front cabinet equipped at the front of the panel; a frame electrically connecting with the back cover; and a grounding member providing with the first point connected with the frame and the second point grounding the film-typed front filter upwardly.

In accordance with another aspect of the present invention, a plasma display panel comprises: a panel; a film-typed front filter attached to a front surface of the panel; a back cover shielding the rear of the panel; a front cabinet equipped at the front of the panel; a frame formed at an edge of the panel; and a grounding member extended from the frame toward the frame to electrically contact with the film-typed front filter; and grounding portion for providing elasticity formed at the grounding member to enchance contact reliability between the grounding member and a film-typed front filter.

In accordance with another aspect of the present invention, a plasma display panel comprises: a panel; a film-typed front filter attached to a front surface of the panel; a back cover shielding the rear of the panel; a front cabinet equipped at the front of the panel; a frame formed at an edge of the panel; and a grounding member extended from the frame toward the frame to electrically contact with the film-typed front filter; and grounding portion for providing elasticity formed at the grounding member to enhance contact reliability between the grounding member and a film-typed front filter.

An EMI and an NIR transmitted to a front surface filter can be smoothly emitted to the outside by a plasma display panel, and a front surface filter may be exactly supported.

In addition, as the front surface filter may be stably supported, and an advantage to improve an operational reliability of a device can be obtained. Furthermore, a grounding structure can be simply manufactured.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
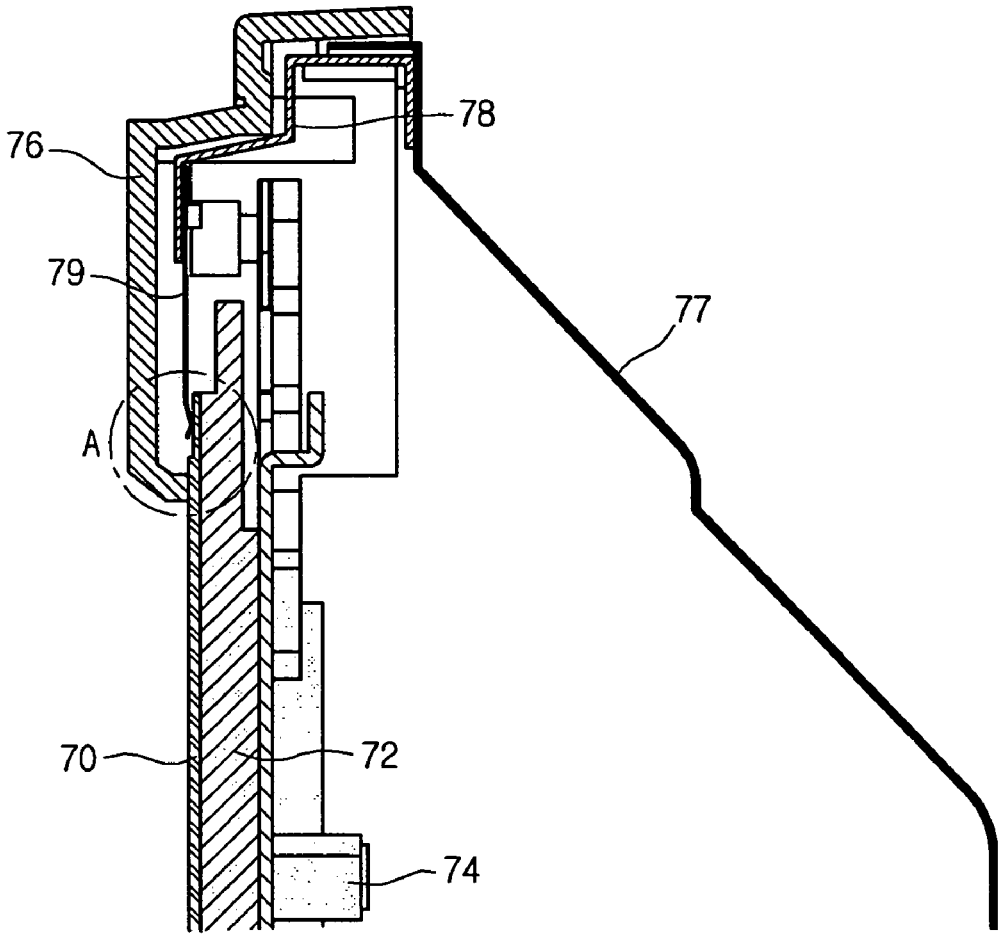
FIG. 1 is a cross-sectional view of a plasma display panel of the present invention viewed from the side.
Figure 2:
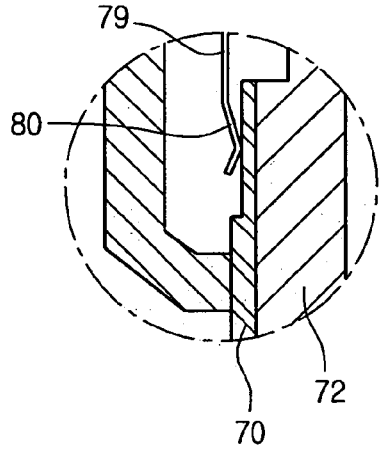
FIG. 2 is an exploded view of "A" in FIG. 1.
Figure 3:
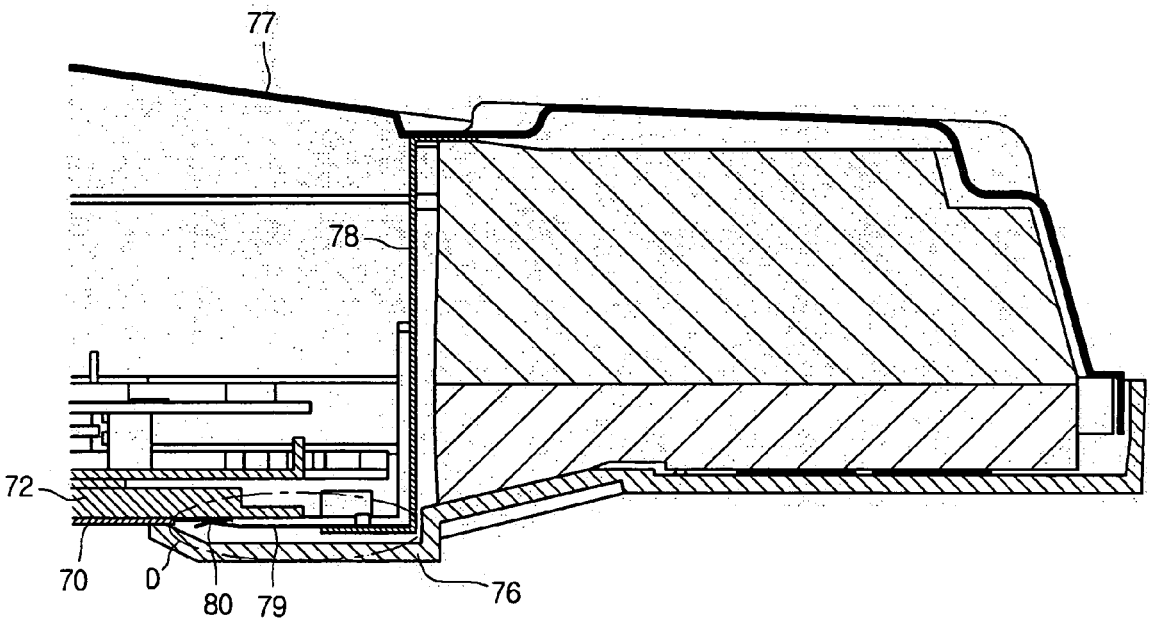
FIG. 3 is a cross-sectional view viewed from the upper side of a plasma display panel of the present invention.
Figure 4:
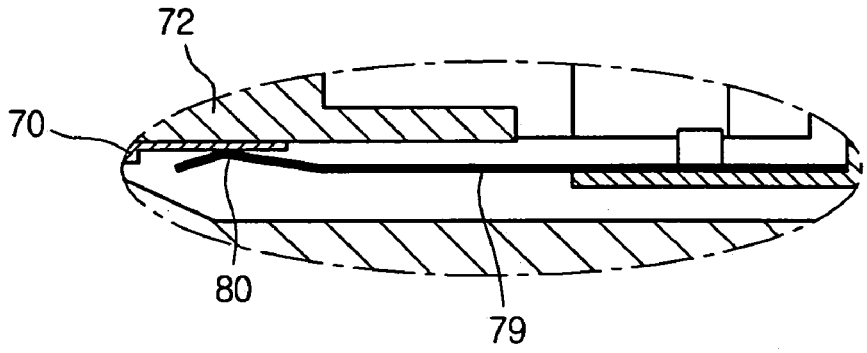
FIG. 4 is an exploded view of "D" in FIG. 3.

FIG. 1 is a cross-sectional view viewed from a side of a plasma display panel of the present invention, and FIG. 2 is an exploded view of "A" in FIG. 1. FIG. 3 is a cross-sectional view of a plasma display panel of the present invention viewed from the upper side, and FIG. 4 is an exploded view of "D" in FIG. 3.

Referring to FIGS. 1 to 4, a plasma display panel according to the present invention comprises: a panel 72 of which an upper substrate is cohered with a lower substrate, and a film-typed front filter 70 provided to a front side of the panel 72. In addition, a radiative plate 74 and a print circuit substrate (not shown) at the rear side of the panel 74, and a back cover 77 wrapping the rear of the panel to entirely protect the panel are provided.

In addition, the plasma display panel in accordance with the present invention has a frame 78 and a grounding member 79 so as to electrically connect with the back cover 77 and the film-typed front filter 70. In addition, a front cabinet 76 supporting an edge of the panel 72 in the forefront of the plasma display panel is formed in order to entirely support a front of the panel 72.

More in detail, the grounding member 79 is grounded at the film-typed front filter 70 to be electrically connected with the frame 78. In addition, the frame 78 is connected with the back cover 77 so that the film-typed front filter 70 grounds with respect to the back cover 77. In addition, the grounding member 79 is coupled with the frame 78 by a screw, and a protrusion-shaped grounding portion 80 is provided at a portion where the film-typed front filter 70 directly contacts with the grounding member 79 so that en grounding of the grounding member 79 and a front filter 70 is exactly performed. It is possible that a grounding between the grounding member 79 and the front filter 70 is not severed in spite of the external impact by the grounding portion 80.

In the meantime, a plurality of layers configuring an upper layer is removed at a portion contacted by the grounding member 80 in the film-typed front filter 70 so that an EMI cutoff layer and a NRI cutoff layer are exposed to the outside for the grounding member 79 to be directly-contacted with the EMI cutoff layer. Thereby, EMI and NIR generated from the film-typed front filter 70 may be directly emitted to the back cover 77 through the grounding member 79.

The configuration and the operation of the panel 72 will be briefly described.

Figure 5:
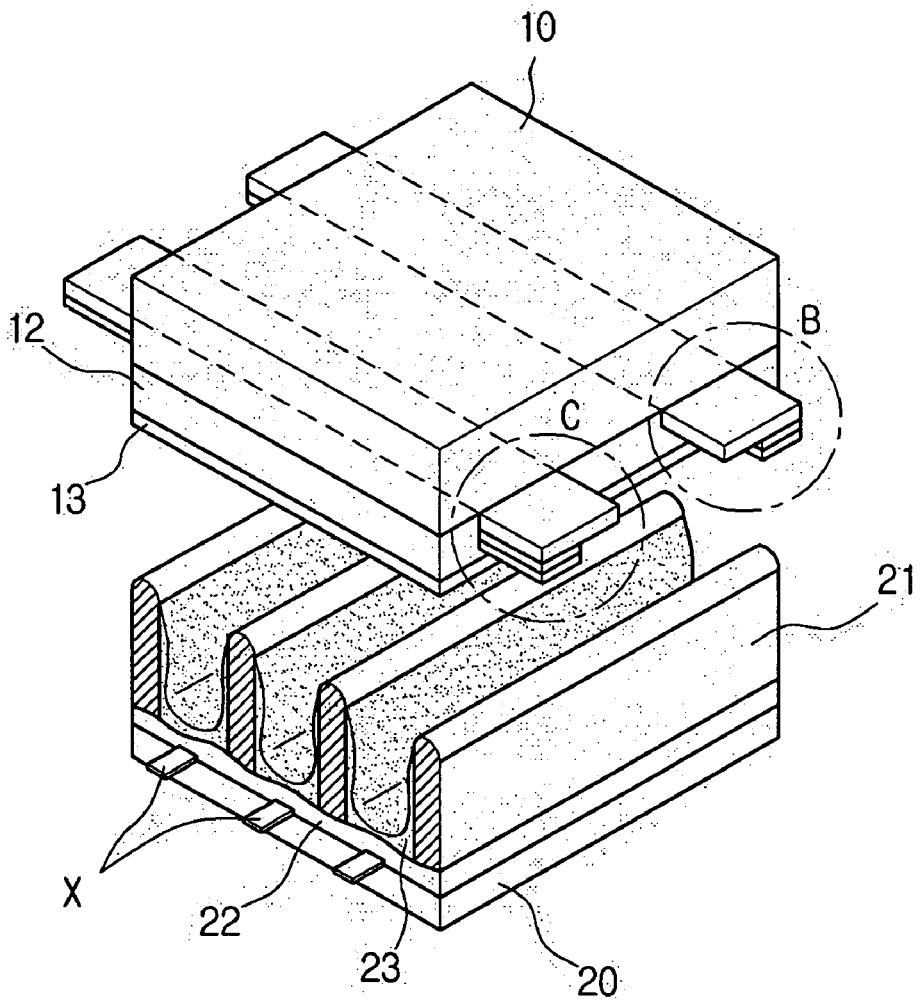
FIG. 5 is a view describing a structure of an electrode current surface discharging plasma display panel.

FIG. 5 is a view describing a structure of an electrode current surface discharging plasma display panel.

Figure 6:
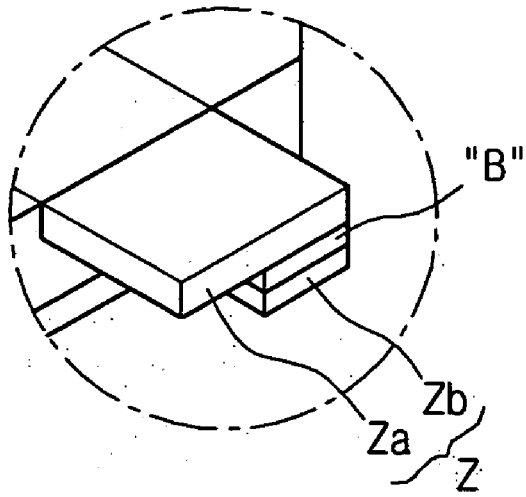
FIG. 6 is an exploded view of "B" in FIG. 5
Figure 7:
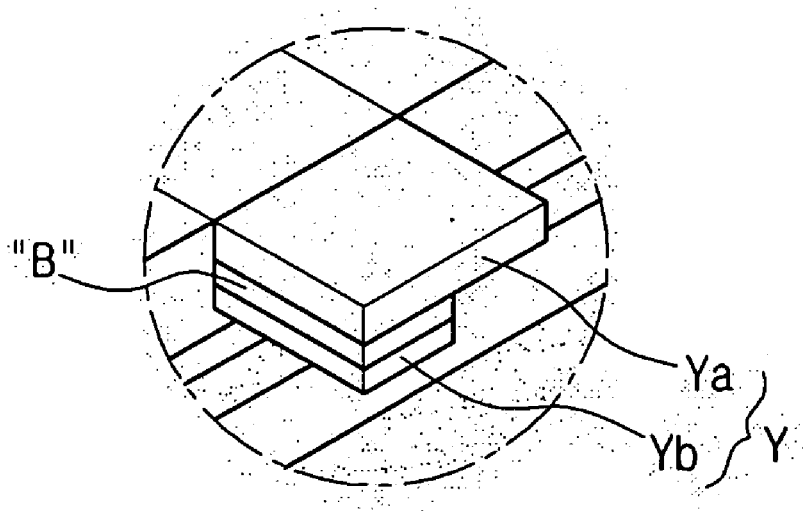
FIG. 7 is an exploded view of "C" in FIG. 5.

FIG. 6 is an exploded view of "B" in FIG. 5 and FIG. 7 is an exploded view of "C" in FIG. 5.

Referring to FIGS. 5 to 7, a plasma display panel is formed by connecting a front substrate 10 where an image is displayed with a rear substrate 20 formed with a predetermined interval from the front substrate 10 by a frit glass. In order to maintain an emitting light of a cell by a discharge, a common maintenance electrode Z, a scan maintenance electrode Y, a dielectric layer 12 for limiting a discharged current of the scan maintenance electrode Y to insulate each electrode and a protection layer 13 for preventing the dielectric layer 12 from being damaged to increase an efficiency of the second discharge.

The common maintenance electrode Z, a plurality of address electrode X generating a vacuum ultraviolet ray by performing an address discharge at a portion intersected by the scan maintenance electrode Y, a dielectric layer 22 insulating the plurality of address electrode X, a plurality of discharging space formed at a side of the dielectric layer 22, or a partition 21 arranged in parallel so that a cell can be formed, and RGB fluorescent layer 23 covered at the side surface of the partition 21 and a portion between the partition 21 and the partition 21 for a visible ray is emitted. In addition, the common maintenance electrode Z has a transparent electrode ITO electrode Za, a bus electrode Zb made of a metal, and a black layer B made of ruthenium oxidation lead or a carbon material for improving a contrast formed between the transparent electrode Za and the bus electrode Zb by a electric conductive material. In addition, the scan maintenance electrode Y has a transparent electrode ITO electrode Ya, a bus electrode Yb made of a metal, and a black layer B made of ruthenium oxidation lead or a carbon material for improving a contrast formed between the transparent electrode Ya and the bus electrode Yb by an electric conductive material.

In addition, a buffer gas is filled between the front surface 10 and the rear surface 20 with a pressure ranging from 300 to 400 Torr, and is mainly a penning mixed gas of He, Ne, Ar or their mixed gas. A small amount of Xe gas is used as a source of a vacuum ultraviolet ray for radiating the fluorescent layer 23.

Figure 8:
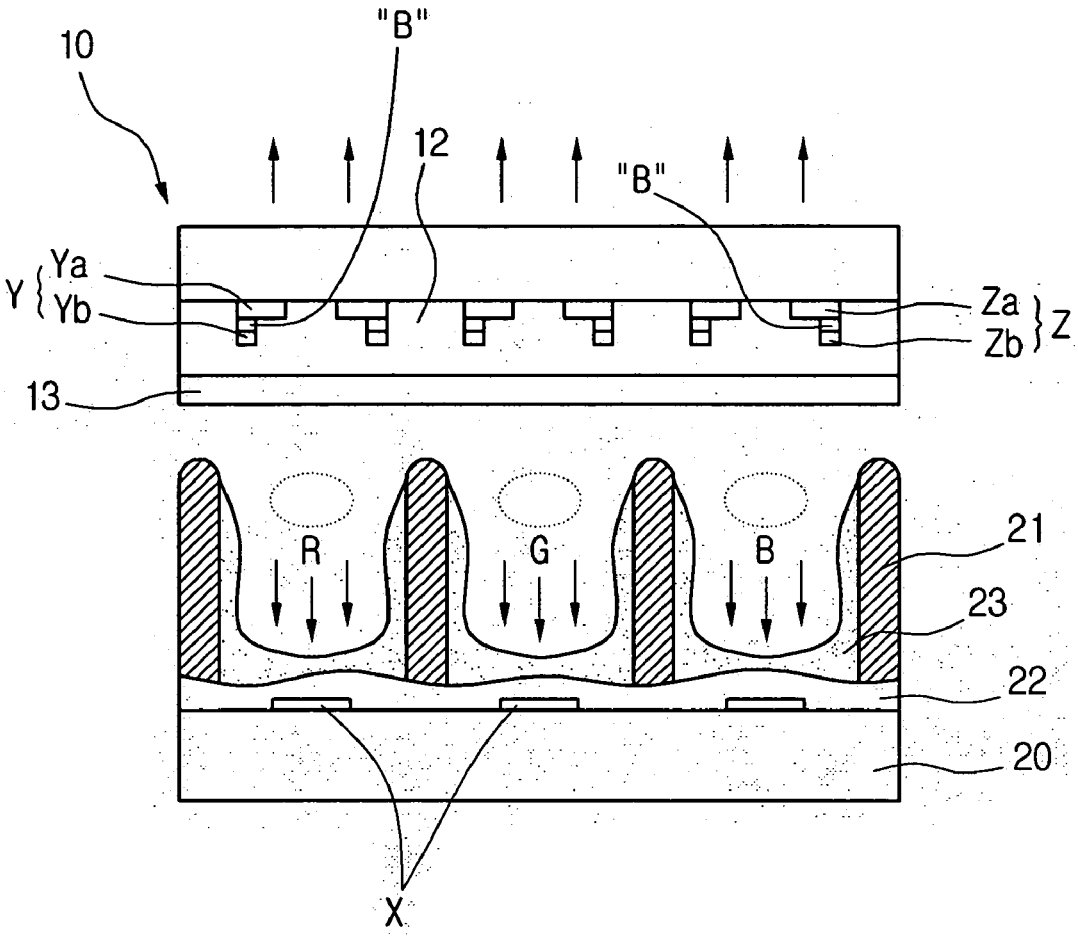
FIG. 8 is a cross-sectional view of a panel.

FIG. 8 is a cross-sectional view of a panel. A process for providing an image in the panel with reference to FIG. 8.

Referring to FIG. 8, an image is displayed at a plasma display panel by an address display separate where data entering period and an indicating period are timely separated.

First, if a voltage ranging from 150 to 300V is applied between the scan maintenance electrode Y and the address electrode X in a mandatory discharge cell, a writing discharge is generated inside the cell located between the scan maintenance electrode Y and the address electrode X to form a wall charge in an inner surface of the corresponding space and remain a wall charge on the dielectric layer 12. In the cells selected by the address discharge, a maintenance discharge occurs by an alternating current signal provided to the common maintenance electrode Z and the scan maintenance electrode Y to generate electric charges in the cell by a discharge and a small amount of gas in the discharge gas is accelerated.

The accelerated electrons are collided with the neutral particles of a gas to be ionized as an electron and an ion, and the neutral particles are ionized as an electron and an ion with a gradually rapid due to another collision of the ionized electrons and the neutral particles to change a discharge gas into a plasma state and generate a vacuum ultraviolet ray. The ultraviolet ray excites the RGB fluorescent layer 23 to generate a visible ray, and the generated visible ray is emitted to the outside through the entire substrate 10 so that a light emitting of a mandatory cell or a displayed image may be recognized in the outside.

This plasma display panel consists of a plurality of subfields in one frame to realize a gradation by the combination of the subfields. For example, if 256 gradations are realized, one frame period is timely separated into eight subfields and eight subfields are divided into a reset period, an address period and a maintenance period, again. An entire screen is initialized at the reset period, cells where data is indicated are selected by the writing discharge in the address period, and a discharge of the selected cells is maintained in the maintenance period.

Here, a reset period and an address period of each sub field are the same at each subfield while the maintenance period is increased at a rate of 2n (n=0, 1, 2, 3, 4, 5, 6, 7) at each subfield. The maintenance periods are different at each subfield, a brightness and a chromaticity of an indicated image is determined in accordance with the combination of the subfields.

As described above, if a panel is operated, a large amount of EMI is generated. If the EMI is not emitted, the plasma display panel is not normally operated, resulting in affecting a substrate of a plasma display panel due to an accumulation of EMI, and providing reasons of a maloperation of a plasma display panel. Of course, if EMI is emitted to the outside, it is natural to badly affect the human body.

In order to overcome the above problems, a front filter 70 is further provided at a front of the panel 72 to block an EMI and a NIR. Especially, a film-typed front filter 70 not including a glass is used as a front filter of the present invention, and a grounding structure is suggested in order to increase an emitting effect of EMI and NIR from the film-typed front filter 70.

Figure 9:
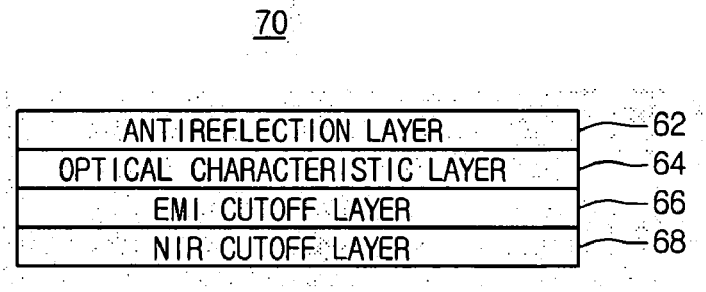
FIG. 9 is a cross-sectional view of a film-typed front filter.

FIG. 9 illustrates a structure of a film-typed front filter.

Referring to FIG. 9, the film-typed front filter 70 has an antireflection layer 62, an optical characteristic layer 64, an EMI cutoff layer 66 and a NIR cutoff layer 68, which are stacked in order. Here, the film-typed front filter 70 has an adhesion layer between the layers 62, 64, 66 and 68 to adhere a contact face between the layers.

In general, the optical characteristic layer 64 is formed by inserting a special material onto an adhesion layer. Is addition, the structures of a film-typed front filter 70 are different depending on the manufacturing companies. An adherence layer is not illustrated in the present invention for explanation convenience, but an optical characteristic layer 64 is indicated as a specific layer. The optical characteristic layer 64 lowers a brightness of red R and green G of the lights impinged from the panel 72 and raises a brightness of blue B to improve optical characteristics of a plasma display panel.

The antireflection layer 62 is formed on a surface of a film-typed front filter 70 to prevent a light impinged from the outside from being reflected to the outside again. This antireflection layer 62 may be additionally formed on the rear of the film-typed front filter 70.

The EMI cutoff layer 66 shields EMI and prevents EMI impinged from the panel 72 from being emitted to the outside. The EMI cutoff layer 66 may be provided in a shape of a conductive line having a net shape.

The NIR cutoff layer 68 shields NIR impinged from the panel 72. The NIR cutoff layer 68 prevents NIR more than the standard from being emitted so that signals transmitted to the panel 72 from a remote controller etc. can be normally filter 70 including a tight glass layer and is advantageous in that the sliming the filter is possible. Furthermore, the film-typed front filter 70 is advantage in that the manufacturing costs may be reduced in comparison with a front filter including a glass 54. However, the film-typed front filter 70 is formed on a front surface of the panel 72, and a grounding member is difficult to contact with an EMI cutoff layer in comparison with the conventional art.

In order to solve the above problems, some layers provided on an upper surface of the film-typed front filter 70 are removed at a portion contacted by the grounding member 79 in the film-typed front filter 70. In this state, the grounding member 79 directly contacts with the EMI cutoff layer 66.

Figure 10:
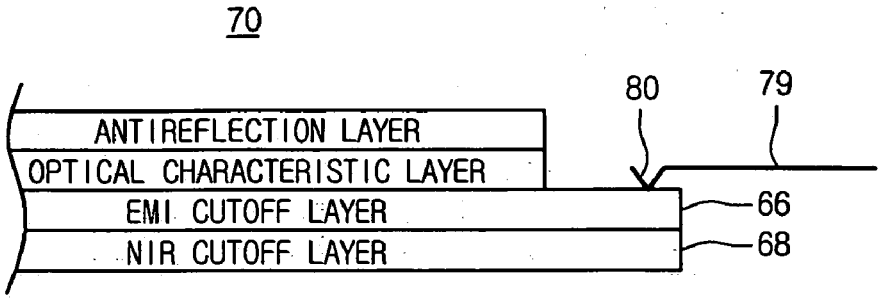
FIG. 10 is a cross-sectional view describing a contact portion of the front filter and the grounding member.

FIG. 10 is cross-sectional view for describing a contact portion of the front filter and the grounding member in detail.

Referring to FIG. 10, a film-typed front filter 70 having a structure where an antireflection layer 62, an optical characteristic layer 64, an EMI cutoff layer 66 and a NIR cutoff layer 68 are sequentially stacked is provided. However, the antireflection layer 62 and the optical characteristic layer 64 are removed from a face where a grounding member 79 contacts the film-typed front filter 70. Therefore, the grounding member 79 can directly contact the EMI cutoff layer 66.

It is preferable that a cross-sectioned shape is entirely formed throughout the edges of a film-typed front filter 70 provided with the grounding member 79.

In addition, the grounding member 80 is formed to have a curvedly protruded shape at a portion where the grounding member 79 directly contacts with the film-typed front filter 70, and an elastic force is provided by the grounding portion 80. Therefore, a reliability of grounding the EMI cutoff layer 66 with respect to the grounding member 79 can be improved. Furthermore, the grounding member 79 has a predetermined elastic force to absorb an impact applying to the film-typed front filter 70 from the outside, accordingly the film-typed front filter 70 can be prevented from being damaged.

A method of grounding the grounding member 79 to the film-typed front filter 70 has been described above, and a method of fixing the grounding member 79 with respect to the film-typed front filter 70 now will be described.

Figure 11:
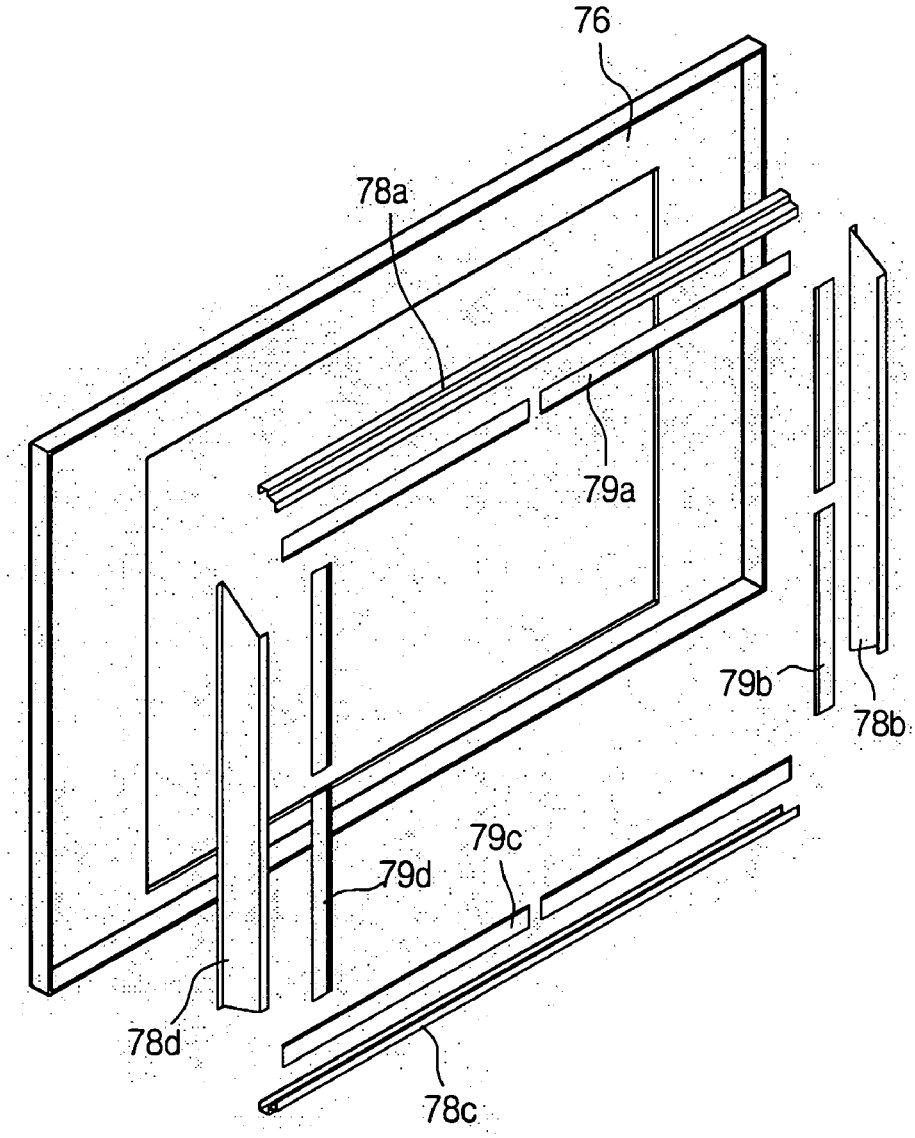
FIG. 11 is a disassembled perspective view of a grounding member, a frame and a front cabinet.
Figure 12:
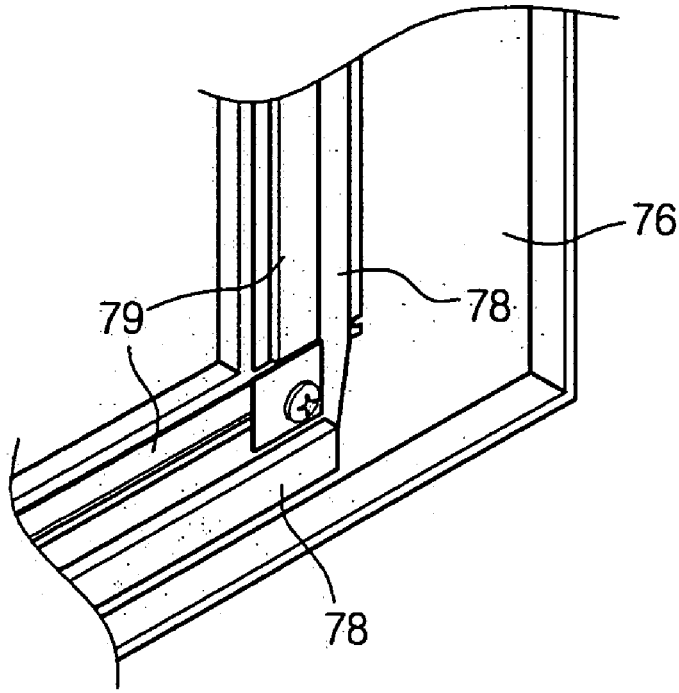
FIG. 12 is an exploded view of a corner portion of a plasma display panel at a state that a grounding member and a frame are connected with a back cover.

FIG. 11 is a disassembled perspective view of a grounding member, a frame and a front cabinet, and FIG. 12 is a view showing an exploded corner of a plasma display panel at a state that a grounding member and a frame are connected with a back cover.

Referring to FIGS. 11 and 12, the frame 78 is connected with the top, bottom, left and right of the inner portion of the front cabinet 76 at a state that each edge is separated in the panel 72. In addition, the frame 78 is inwardly combined with the grounding member 79, which is electrically connected with the film-typed front filter 70. In other words, the grounding member 79 grounds the film-typed front filter 70 to electrically connected with the frame 78. In addition, the grounding member 79 is connected with the frame by a screw.

As described above, the front cabinet 76 is connected with the frame 78 and the panel 72 at the state that the film-typed front panel 70 is attached to the panel 72, a grounding member 79 grounds in the film-typed front panel 70, the grounding member 79 is connected with the frame 78 by a screw and the frame 78 is connected with the back cover 77. Since a combination between the frame 78 and the panel 72 is improved by the front cabinet 76, a reliability of electric contact of the grounding member 79 and the film-typed front filter 70 is further improved.

Meanwhile, the panel 72 indicates a predetermined image in response to a driving signal supplied by a print circuit substrate in the plasma display panel configured as above, and the back cover 77 protects the panel 72 from a rear impact and shields an EMI emitted from the rear surface of the plasma display panel.

In addition, the frame 78 and the grounding member 70 electrically connect a film-typed front filter 70 with the back cover 77 and shields an EMI emitted from the side of the plasma display panel.

Furthermore, the film-typed front filter 70 shields an EMI emitted to a front surface of a plasma display panel and prevents an external light from being reflected. In addition, the brightness of red R and green G is lowered and the brightness of blue B is raised to improve an optical characteristic of PDP. Moreover, the film-typed front filter 70 shields NIR to prevent a maloperation of a remote controller.

As described above, a plasma display panel according to the present invention can obtain effects of making slim, reducing manufacturing costs and a weight by attaching a film-typed front filter on a front surface of a panel to stably connect a grounding member with a film-typed front filter.

In addition, the plasma display panel according to the present invention has an advantage of effectively supporting a film-typed front filter formed on a front surface of a panel and grounding it. Moreover, a grounding structure is conveniently made for improving a manufacturing convenience.

What is claimed is:

1. A plasma display device comprising:

a panel;

a film-typed front filter attached to a front surface of the panel;

a back cover installed at the rear of the panel;

a front cabinet equipped at the front of the panel;

a frame electrically connected with the back cover; and a grounding member having a first point coupled to the frame and a second point grounding the film-typed front filter, wherein the film-typed front filter comprises an antireflection layer, an optical characteristic layer, an EMI cutoff layer and a NIR cutoff layer, and wherein the antireflection layer and the optical characteristic layer are removed at a position where the film-typed front filter is coupled to the grounding member and the second point of the grounding member directly contacts a front surface of the EMI cutoff layer and grounds the front surface of the EMI cutoff layer directly.

2. The plasma display device of claim 1, wherein the second point has a curved structure.

3. The plasma display device of claim 1, wherein the grounding member is provided with a predetermined elastic force at the second point.

4. The plasma display device of claim 3, wherein the grounding member is bent to establish a permanent bias force that corresponds to the predetermined elastic force at the second point, the bias force causing the second point of the grounding member to remain in direct contact with the front side of the EMI cutoff layer when no external force is applied.

5. The plasma display device of claim 1, wherein the frame and/or the grounding member is provided with separate article at four edges of the panel.

6. The plasma display device of claim 1, wherein the frame shields an EMI provided at four edges of the panel to be leaked to the side direction of the panel.

7. The plasma display device of claim 1, wherein the second point of the grounding member grounds the film-typed front filter upwardly.

8. The plasma display device of claim 1, wherein the antireflection layer, optical characteristic layer, EMI cutoff layer and NIR cutoff layer are provided in series within the film-typed front filter.

9. The plasma display device of claim 1, wherein the optical characteristic layer includes one or more materials that lower a brightness of at least one color of light and increases a brightness of at least one other color of light.

10. The plasma display device of claim 1, wherein the one or more materials of the optical characteristic layer lowers the brightness of at least one of red light or green light and increases the brightness of blue light.

11. The plasma display device of claim 10, wherein the one or more materials of the optical characteristic layer are inserted into an adhesion layer.

12. The plasma display panel of claim 10, wherein the one or more materials of the optical characteristic layer lowers the brightness of red light and green light and increases the brightness of blue light.

* * * * *